United States Patent [19]

Bang

[11] Patent Number: 4,552,040

[45] Date of Patent: Nov. 12, 1985

[54] OIL FILTER WRENCH

[76] Inventor: Hyo J. Bang, 805 S. Cerritos, Ave., #D-1, Azusa, Calif. 91702

[21] Appl. No.: 663,305

[22] Filed: Oct. 22, 1984

Related U.S. Application Data

[63] Continuation-in-part of Ser. No. 599,008, Apr. 11, 1984, abandoned.

[51] Int. Cl.[4] ..... B25B 13/52

[52] U.S. Cl. ..... 81/65; 81/3.43; 81/64

[58] Field of Search ..... 81/64, 65, 3.43

[56] References Cited

U.S. PATENT DOCUMENTS

| | | | |
|---|---|---|---|
| 221,655 | 11/1979 | House et al. | 81/3.43 |
| 988,780 | 4/1911 | Horwath | 81/3.43 |
| 1,422,626 | 7/1922 | Shank | 81/3.43 |
| 1,434,760 | 11/1922 | Wunder | 81/3.43 |
| 1,498,009 | 6/1924 | Ball | 81/3.43 |
| 1,797,446 | 5/1931 | Salmon | 81/64 |
| 1,953,238 | 4/1934 | Kosanovich | 81/3.43 |
| 2,076,813 | 4/1937 | Fiedler | 81/3.43 |
| 2,181,012 | 11/1939 | Bunting | 81/64 |
| 2,458,329 | 1/1949 | Archer | 81/3.43 |
| 2,766,648 | 10/1956 | Jazwieck | 81/3.43 |

FOREIGN PATENT DOCUMENTS

| | | | |
|---|---|---|---|
| 246955 | 11/1947 | Switzerland | 81/3.43 |

*Primary Examiner*—James G. Smith
*Assistant Examiner*—J. T. Zatarga
*Attorney, Agent, or Firm*—Fulwider, Patton, Rieber, Lee & Utecht

[57] ABSTRACT

An improved wrench includes a rigid band extending between a pair of spaced-apart end plates which are supported directly upon a common threaded shaft. In a preferred form of the invention, the band has a plurality of sequential and incremental flat surfaces extending along one edge between the end plates, and a file-like inner gripping surface strengthened by a V-shaped ridge forming the remainder of the band. As the shaft is rotated by hand about its longitudinal axis, one end plate remains generally stationary with respect to the shaft while the other end plate moves along the shaft either toward or away from the stationary end plate, depending on the direction of shaft rotation. When placed about a portion of an article such as an oil filter or the like, movement of the end plates toward one another causes the inner surfaces of the band to substantially uniformly grip the article about its circumference. This permits the application of high torque forces to the article without any slippage of the wrench about the article.

21 Claims, 5 Drawing Figures

OIL FILTER WRENCH

RELATED APPLICATION

This application is a continuation-in-part of Application Ser. No. 06/599,008, filed Apr. 11, 1984 now abandoned.

BACKGROUND OF THE INVENTION

This invention relates generally to tools useful in automotive maintenance and, more specifically, to an adjustable wrench for securely gripping and twisting an oil filter to tighten or loosen the filter when threaded onto a filter mount.

The importance of automobiles and other motorized vehicles in reliably and efficiently transporting people and goods has encouraged the growth of what has become a large service industry devoted to maintaining and repairing such vehicles. It is generally recognized that regular periodic maintenance for vehicles such as cars, trucks, buses and the like, is necessary to keep the engines of these vehicles running at peak efficiency and to minimize or prevent premature mechanical failures. The trend to reduce the size of many automobiles, and the regular inclusion of auxiliary components, such as air conditioning and smog control devices, within engine compartments has limited access to some of the engine components requiring regular maintenance and has required, in some instances, the use of special tools. For example, in many engine compartments the location and size of the oil filter has made it virtually impossible or impractical to either loosen or tighten the filter utilizing standard wrenches or clamps. Because of such problems, several tools have been developed which facilitate the emplacement or removal of the oil filter from an engine filter mount.

One of these tools is a levered wrench having generally a smooth flexible band attached to a levered handle which tightens the band about an oil filter as the handle is pulled through an arc around a portion of the oil filter. The movement of the handle through the arc causes, in theory, the band to frictionally engage and securely grip the outer surface of the oil filter. As extra force is applied to further move the handle through the arc about the oil filter, that force will be transferred through the wrench to apply a torque upon the filter for twisting it. Such levered wrenches have several drawbacks, however, in that the frictional engagement between the smooth flexible band and the underlying portion of the oil filter cannot always be relied upon to securely hold the filter within the wrench and prevent slipping as greater torque is applied. Also, due to the combined tightening and twisting action of the handle, these wrenches are inherently unidirectional after placement, and if incorrectly positioned they must be removed and repositioned for tightening or loosening of the filter as required. Further, many such wrenches can accommodate only a rather narrow size range of oil filters due to the leveraging action of the handle, and the placement of oil filters in some engine compartments makes use of such wrenches impractical because the area through which the levered handle can be pulled is less than that area required to simply tighten the band about the filter.

Another tool for emplacing or removing an oil filter from an engine filter mount includes an enlarged socket which can be placed over the end of the oil filter to engage a series of flat surfaces typically surrounding and adjacent the outwardly extending end of the filter. A ratchet-type wrench can be connected to this enlarged socket to twist the oil filter as desired. As in the case of the levered wrenches, such enlarged socket wrenches also have several drawbacks which have limited their use and widespread acceptance. For instance, because there are many different types and brands of oil filters available, a mechanic servicing different makes and models of vehicles may find it necessary to purchase several of the enlarged sockets to accommodate the various sizes of filters encountered. Moreover, such enlarged socket wrenches are reliant upon the provision of a plurality of flat surfaces adjacent the outwardly extending end of the oil filter for gripping the oil filter. If these flat surfaces are not provided, or if they have been malformed or damaged, the enlarged socket wrenches may be incapable of securely gripping the oil filter as required.

Accordingly, there has been a need for a novel oil filter wrench which can adjustably accommodate many different sizes of oil filters and the like, and securely grip an oil filter, without slipping, while torque is being applied through the wrench to the filter. Further, the novel oil filter wrench must be sturdy, capable of being used effectively in the limited space provided within many engine compartments, and built to twist the filter in either a clockwise or counter clockwise direction notwithstanding the positioning of the wrench upon the filter. Finally, there exists a significant need for an easily manufactured and economical oil filter wrench which can be advantageously used by the professional mechanic as well as the home repairman to safely and reliably tighten or loosen oil filters in a variety of situations and applications. The present invention fulfills these needs and provides other related advantages.

SUMMARY OF THE INVENTION

The present invention resides in an improved wrench which can be adjusted to securely grip oil filters and the like while applying torque through the wrench for twisting the filters. The improved wrench comprises generally a rigid gripping band extending between a pair of spaced-apart end plates positioned by and supported upon a threaded shaft. As the shaft is rotated about its longitudinal axis, the distance between the end plates either increases or decreases, depending on the direction of shaft rotation. When the improved wrench is placed around an oil filter, the relative movement of the end plates along the shaft toward one another tends to tighten the wrench about the filter by decreasing the area lying between the band and the portion of the shaft separating the end plates. Conversely, the relative movement of the end plates along the shaft away from one another tends to loosen the wrench about the filter by increasing the area lying between the band and the portion of the shaft separating the end plates.

In a preferred form of the invention, a travelling end plate moves along the length of the threaded shaft toward and away from a generally stationary end plate in response to rotation of the threaded shaft. Extending the length of the band between the end plates, a plurality of sequential and incremental flat surfaces are provided along one edge of the band, which can be positioned over complementary flat surfaces typically provided adjacent the outwardly extending end of many oil filters. The remainder of the band forms a file-like inner gripping surface which is strengthen by an outwardly extending, V-shaped ridge. The sequential flat surfaces and the file-like inner gripping surface combine to provide a much stronger grip on the oil filter as the wrench is tightened than has been available with prior wrenches. A handle is provided at a free end of the threaded shaft to facilitate the manual rotation of the shaft and twisting of the filter as required.

When the rigid band is properly positioned and tightened about the circumference of the oil filter, a joint between each end plate and the band selectively acts as a fulcrum point for the shaft in transmitting forces to the oil filter. As the handle is pulled through an arc around the filter to twist the filter, the shaft will tend to press one of the end plates, and consequently one of the fulcrum points, into the filter, and simultaneously pull the other end plate away from the filter. This pressure upon one of the fulcrum joints enhances the gripping power of the wrench by creating and maintaining a higher frictional coefficient between a portion of the wrench and the underlying filter than is usually obtainable with prior oil filter wrenches.

The improved wrench lends itself well to use with a variety of sizes and styles of oil filters and, because no linear movement of the handle or shaft is required for tightening the wrench about the filter, the wrench can be advantageously utilized where working space is limited. Also, because the improved wrench securely grips the oil filter and permits it to be twisted in either direction when the band is tightened, the possibility of incorrectly placing the wrench upon the filter has been reduced.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
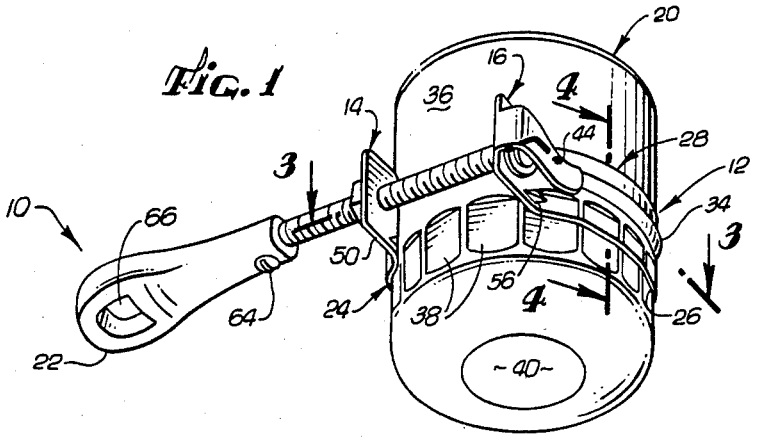
FIG. 1 is a perspective view of an improved wrench embodying the invention, illustrating the manner in which the improved wrench is placed about an oil filter for twisting the same.
Figure 4:
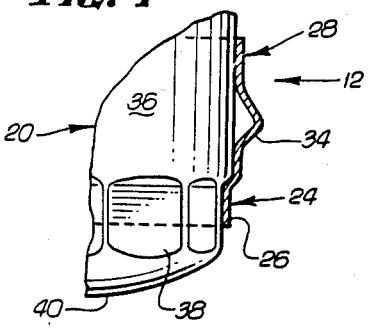
FIG. 4 is an enlarged, fragmented sectional view taken generally along the line 4—4 of FIG. 1, illustrating the positioning of a rigid band adjacent a portion of the outer cylindrical surface of the oil filter.

As shown in the drawings for purposes of illustration, the present invention is concerned with an improved wrench, generally designated by the reference number 10. This improved wrench 10 generally comprises a rigid gripping band 12 extending between a pair of spaced-apart end plates 14 and 16 which are positioned by and supported upon a threaded shaft 18. As the shaft 18 is rotated about its longitudinal axis, the distance between the end plates 14 and 16 either increases or decreases, depending on the direction of shaft rotation. When the improved wrench 10 is placed around an oil filter 20 or the like, the relative movement of the end plates 14 and 16 along the shaft 18 toward one another tends to tighten the wrench about the filter by decreasing the area lying between the band 12 and the portion of the shaft separating the end plates. Conversely, the relative movement of the end plates 14 and 16 along the shaft 18 away from one another tends to loosen the wrench 10 about the filter 20 by increasing the area lying between the band 12 and the portion of the shaft separating the end plates.

The wrench 10 of the present invention presents a significant improvement over prior wrenches because it is adjustable to securely grip a wide range of sizes and types of oil filters 20 and the like, without slipping while torque is being applied through the wrench to the filter, due to the wide range of movement allowed the end plates 14 and 16 with respect to one another along the threaded shaft 18. Also, the usefulness of the improved wrench 10 in limited space applications is enhanced since the shaft 18 is simply twisted about its longitudinal axis to tighten or loosen the band 12. There is no need to move the shaft 18, or a handle 22 provided at the free end of the shaft, either linearly or through a broad arc to effect such tightening. Moreover, once positioned upon the oil filter 20, the improved wrench 10 can be used to twist the filter in either a tightening or loosening direction notwithstanding the positioning of the wrench upon the filter.

In accordance with the present invention, and as illustrated in FIGS. 1 through 5, the rigid band 12 includes a lower sectiion 24 forming a plurality of sequential and incremental flat surfaces 26, and an upper section 28 forming two parallel file-like inner gripping surfaces 30 and 32, which are separated and strengthened by an outwardly extending V-shaped ridge 34. In use, this upper section is preferably placed adjacent a smooth portion 36 of the oil filter 20 outer cylindrical surface, and the reinforcing ridge 34 is situated along the width of the upper section 28 to principally add strength and rigidity to the rigid band 12. Moreover, as can be seen best in FIG. 4, the upper section 28 can be situated in a different cross-sectional plane than the lower section 24, if desired.

The lower section 24 of the rigid band 12 provides the improved wrench 10 a significant advantage over many prior oil filter wrenches. The sequential flat surfaces 26 generally cooperate with complementary flat surfaces 38 typically provided adjacent an outwardly extending end 40 of many oil filters 20, to substantially surround the outwardly extending end in a manner much the same as a socket wrench surrounds a nut. Even if these sequential flat surfaces 26 provided by the wrench 10 were sized differently than the complementary flat surfaces 38 on the oil filter 20, the non-curvilinear inner surface formed by the sequential flat surfaces would interact with the underlying complementary flat surfaces to, generally, more securely hold the oil filter within the wrench than if a plain, smooth flexible band was provided. Furthermore, oil filters 20 and the like which do not have the complementary flat surfaces 38 can also be securely grasped by the combination of gripping surfaces provided by the plurality of flat surfaces 26 and the file-like gripping surfaces 30 and 32, because the wrench 10 of the present invention is capable of being tightened sufficiently to frictionally engage the filter in a manner preventing any slipping of the wrench about the filter as torque is applied.

Figure 3:
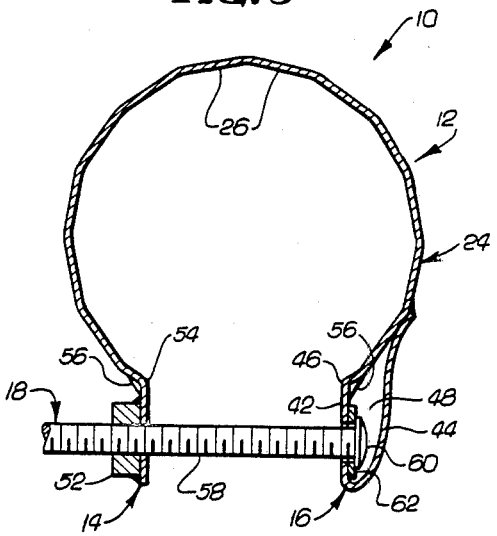
FIG. 3 is an enlarged, fragmented sectional view taken generally along the line 3—3 of FIG. 1.
Figure 2:
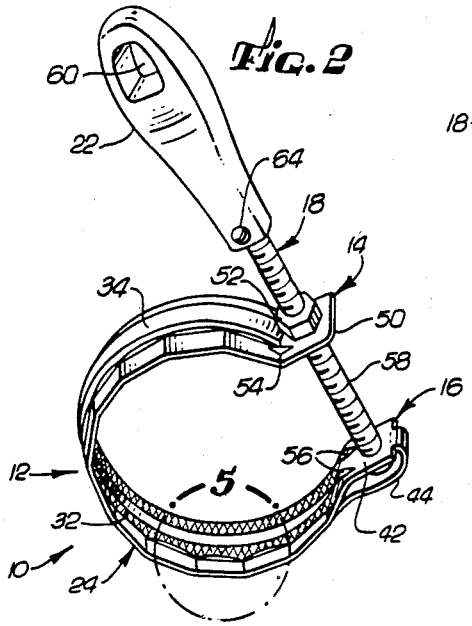
FIG. 2 is a perspective view of the improved wrench illustrated in FIG. 1, illustrating the wrench when removed from the oil filter.
Figure 5:
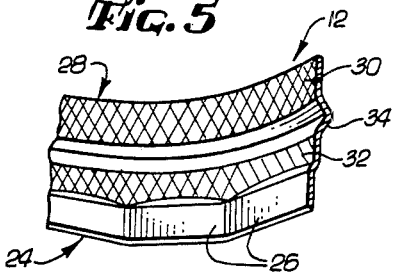
FIG. 5 is an enlarged, fragmented perspective view of a portion of the inner surfaces of the rigid band indicated by the line 5 in FIG. 2.

As best illustrated in FIGS. 1 through 3, the end plate 16 includes a stationary flat arm 42 having an enlarged aperture, and an integral retainer strap 44. The stationary arm 42 is rigidly connected to one end of the rigid band 12 at a stationary fulcrum joint 46, and the retainer strap 44 loops from the end of the stationary arm opposite the stationary joint back to the rigid band where it is securely attached to form a retaining space 48 between the stationary arm and the retainer strap. The other end plate 14, includes a travelling flat arm 50 and an attached threaded nut 52. The travelling arm 50 is rigidly connected to the remainder of the rigid band 12 at a travelling fulcrum joint 54, and the threaded nut 52 is rigidly aligned with an aperture through the travelling arm. The joints 46 and 54 between the band 12 and the flat arms 42 and 50 are strengthened by the inclusion of diamond-shaped props 56 integrally formed into adjacent ones of the arms and joints. As shown, the props 56 are concave when viewed from within the arc formed by the band 12, and convex when viewed from the opposite side.

The threaded shaft 18, which passes through the apertures of the end plates 14 and 16, generally comprises a threaded rod 58 capped at one end by an expanded head 60, and an anchor portion forming the shaft end opposite the expanded head. The threaded shaft 18 engages each end plate differently, in the illustrated embodiment, to maintain the stationary end plate 16 at a location generally adjacent the shaft expanded head 60 and to cause the travelling end plate 14 to move along the length of the threaded rod 58 in response to shaft rotation. To maintain the stationary end plate 16 generally adjacent the shaft expanded head 60, the enlarged aperture through that plate is preferably sized to permit the threaded rod 58 to rotate freely therein. Also, the shaft expanded head 60 is positioned within the retaining space 48 so that the expanded head's linear movement, with respect to the strap and stationary arm 42, is limited. The expanded head 60 is separated from the stationary end plate 16 by a washer 62 which reduces wear on both the stationary end plate and the expanded head caused by extended frictional contact between the two when the shaft 18 is rotated.

Another portion of the threaded rod 58 extends through the travelling end plate aperture and engages the aligned nut 52 in a manner allowing movement of the travelling end plate 14 along the length of the threaded rod only in response to rotation of the shaft 18. The handle 22 is securely attached to the anchor portion of the shaft 18 to provide a convenient and comfortable surface which can be grasped for manually turning the shaft. In the illustrated embodiment, the handle 22 is securely positioned upon the shaft 18 by means of a set screw 64, however many other conventional forms of secure attachment would suffice. The illustrated handle 22 also includes a handle assist aperture 66 which is provided for the convenience of the user and can advantageously be used when extra leverage is needed to loosen or tighten the wrench 10.

Before placing the improved wrench 10 on the oil filter 20, the shaft 18 should be rotated to move the travelling end plate 14 away from the stationary end plate 16 along the longitudinal axis of the threaded rod 58. When a right-handed thread is provided the threaded rod 58, a clockwise rotation of the handle 22 will cause the shaft 18 to move through the nut 52, drawing the handle toward the nut and enlarging the area between the rigid band 12 and the portion of the shaft between the end plates 14 and 16. After the rigid band 12 has been sufficiently spread, the wrench 10 can be placed over the outwardly extending end 40 of the oil filter 20 and positioned so that the sequential flat surfaces 26 of the lower section 24 are situated generally adjacent the complementary flat surfaces 38 of the oil filter, and the file-like surfaces 30 and 32 of the upper section 28 are situated generally adjacent the cylindrical outer body portion 36 of the oil filter. Because the upper and lower sections 28 and 24 are situated in slightly different cross-sectional planes to conform to the outer surface of the oil filter 20, the improved wrench 10 will tend to automatically become positioned as described when placed over the end 40 of the oil filter.

Assuming a right-handed thread, counter-clockwise rotation of the handle 22 will draw the threaded rod 58 through the nut 52, moving the travelling end plate 14 away from the handle and toward the stationary end plate 16. Due to the nut and bolt relationship between the shaft 18 and the travelling end plate 14, the amount of tightening of the improved wrench 10 around the oil filter 20 is limited only by the inherent strength of the materials used in the wrench and oil filter. This provides a significant advantage over the prior levered wrenches because frequently such levered wrenches could not be tightened sufficiently to prevent undesirable slipping. The present wrench 10 is also advantageous in that the rigid band 12 can be tighened without any linear or arc-like movement of the handle 22. As previously discussed, this is an important consideration where the working space provided for loosening or tightening the oil filter 20 is severely restricted, as in many engine compartments.

After the improved wrench 10 has been securely tightened about the oil filter 20, the handle 22 may be swung through an arc about the oil filter to twist it in either a clockwise or counter-clockwise direction, without any further adjustment of the wrench about the filter being necessary. In contrast, many previous oil filter wrenches have required some type of adjustment prior to switching directions. For example, when using the levered oil filter wrench, the wrench must be completely removed from the oil filter 20 and repositioned to turn the filter in an opposite direction.

The improved wrench 10 has superior gripping capabilities than prior wrenches due to the inclusion of the plurality of flat surfaces 26 as part of the rigid band 12, and the interaction between the oil filter 20 being twisted and the fulcrum joints 46 and 54. When the rigid band 12 is properly positioned and tightened about the circumference of the oil filter 20, the joints 46 and 54 between the end plates 16 and 14 and the rigid band selectively act as a fulcrum points for the shaft 18 in transmitting forces to the oil filter. As the handle 22 is pulled through an arc around the filter 20 to twist the filter, the shaft 18 will tend to press one of the end plates 14 and 16, and consequently one of the fulcrum joints 46 and 54, into the filter and simultaneously tend to pull the other end plate away from the filter. This pressure upon one of the fulcrum joints 46 or 54 enhances the gripping power of the wrench 10 by creating a higher frictional coefficient between the filter 20 and the wrench than has usually been obtainable with prior oil filter wrenches.

For example, with the wrench 10 positioned on the oil filter 20 as shown in FIG. 1, as the handle 22 is turned to twist the filter in a clockwise direction the fulcrum joint 54 between the travelling end plate 14 and the remainder of the rigid band 12 tends to be pulled away from the outer surface of the oil filter, and the fulcrum joint 46 between the stationary end plate 16 and the remainder of the rigid band is pressed against the oil filter. In many such cases, the frictional coefficient between the stationary fulcrum joint 46 and the oil filter 20 exceeds the frictional coefficient at any other point of contact between the wrench 10 and the filter. Conversely, when the handle 22 is pulled in a direction to twist the oil filter 20 in a counter-clockwise direction, the travelling fulcrum joint 54 is pressed against the filter, and the stationary fulcrum joint 46 tends to be lifted away from the oil filter. Of course, the improved wrench 10 could be provided a relatively sharp joint or joints which would tend to permanently deform or puncture the outer surface of the oil filter 20 when a great enough force was exerted. However, it is presently preferred that permanent deformation of the oil filter body be held to a minimum.

As has become apparent from the foregoing, the improved wrench 10 of the present invention can be advantageously used in a variety of applications. Since the end plates 14 and 16 move relative to one another along the longitudinal axis of the shaft 18 in response to rotation of that shaft, the improved wrench 10 can be adjusted to securely hold many differently sized and shaped oil filters 20. Also, the simplified construction of the wrench 10 facilitates the inexpensive manufacture of a highly desirable product which is durable, safe and reliable. Finally, because only the end plates 14 and 16 are moved toward one another when tightening the wrench 10, and due to the superior gripping strength provided by the rigid band 12 and the fulcrum joints 46 and 54, the wrench can be advantageously used for high torque applications in areas of limited working space.

Although a particular embodiment of the invention has been described in detail for purposes of illustration, various modifications may be made without departing from the spirit and scope of the invention. For example, a variety of handles 22 can be provided for attachment to the shaft 18. Additionally, different types of threaded connectors could be attached to the travelling end plate 14 in place of the nut 52. Moreover, an alternate design could provide for the movement of the end plate 16 along the threaded rod 58 in response to rotation of the shaft 18. Accordingly, the invention is not to be limited, except as by the appended claims.

I claim:

1. An adjustable oil filter wrench, comprising:

a handle;

a threaded shaft securely attached to and extending from said handle, said shaft terminating at an expanded head;

a stationary plate having an enlarged aperture through which a portion of said shaft which is generally adjacent said expanded head freely passes, and an integral retainer strap which forms a retaining space wherein said expanded head is loosely situated;

a traveling plate having an aperture through which said shaft extends;

means for moving said traveling plate along the length of said shaft in response to rotation of said shaft about its longitudinal axis, said traveling plate moving toward or away from said stationary plate depending on the direction of rotation of said shaft; and a rigid band extending between said stationary plate and said traveling plate, said rigid band including a plurality of sequential and incremental flat surfaces extending generally along one edge thereof, and a file-like inner gripping surface strengthened by a V-shaped ridge forming the remainder of said band.

2. A wrench as set forth in claim 1, wherein said moving means comprises a threaded nut which is securely attached to said traveling plate and aligned with said aperture through which said shaft extends.

3. A wrench as set forth in claim 1, including means for reducing wear between said expanded head and said stationary plate caused by the rotation of said shaft about its longitudinal axis.

4. A wrench as set forth in claim 3, wherein said reducing means comprises a washer.

5. A wrench as set forth in claim 1, wherein said plurality of sequential and incremental flat surfaces is situated in a different cross-sectional plane than said file-like inner gripping surface.

6. A wrench as set forth in claim 1, wherein said file-like inner gripping surface is split into two separate segments which are separated by and integrally connected to said V-shaped ridge.

7. A wrench as set forth in claim 6, wherein a first of said segments is situated between said plurality of flat surfaces and said V-shaped ridge, and extends between said stationary and traveling plates.

8. A wrench as set forth in claim 7, wherein a second of said segments extends along the opposite edge of said band with respect to said plurality of flat surfaces.

9. A wrench as set forth in claim 1, wherein said shaft combines with said band to completely encircle a portion of the circumference of an oil filter, said shaft being positioned tangentially to the nearest portion of the outer surface of the filter when said wrench is properly adjusted for the twisting of the filter.

10. An adjustable wrench, comprising:

a rigid band having a plurality of sequential and incremental flat surfaces extending along one edge thereof, and a file-like inner gripping surface extending along the opposite edge, said band being formed to have a curvature generally resembling a portion of a circle;

a first end plate rigidly attached to a first end of said band, said first end plate being oriented to extend perpendicularly outwardly from that portion of said band to which it is attached;

a second end plate rigidly attached to a second end of said band, said second end plate being oriented to extend perpendicularly outwardly from that portion of said band to which it is attached;

a shaft upon which said first and second end plates are directly mounted; and means for moving said end plates toward and away from one another, movement of said end plates toward one another causing said wrench to tighten about an article surrounded by said band and said shaft, and movement of said end plates away from one another causing said wrench to become loosened about an article surrounded by said band and said shaft.

11. A wrench as set forth in claim 10, wherein said plurality of sequential and incremental flat surfaces is situated in a different cross-sectional plane than said file-like inner gripping surface.

12. A wrench as set forth in claim 11, wherein said file-like inner gripping surface is split into two separate segments, each extending the length of said band, said segments being separated by and integrally connected to a V-shaped strengthening ridge.

13. A wrench as set forth in claim 12, wherein a first of said segments is situated between said plurality of flat surfaces and said V-shaped ridge.

14. A wrench as set forth in claim 13, wherein a second of said segments extends along the opposite edge of said band with respect to said plurality of flat surfaces.

15. A wrench as set forth in claim 10, wherein said shaft provides a handle which can be grasped and pulled to apply a torque force to the article through said wrench.

16. A wrench as set forth in claim 10, wherein said shaft includes an expanded head at one end thereof.

17. A wrench as set forth in claim 16, wherein said first end plate includes an enlarged aperture through which a portion of said shaft which is generally adjacent said expanded head freely passes, and an integral retainer strap which forms a retaining space wherein said expanded head is loosely situated.

18. A wrench as set forth in claim 17, wherein said second end plate includes an aperture through which said shaft extends, and a threaded nut which is aligned with said aperture.

19. An adjustable oil filter wrench, comprising:

a handle;

a threaded shaft securely attached to and extending from said handle, said shaft terminating at an expanded head;

a stationary plate having an enlarged aperture through which a portion of said shaft which is generally adjacent said expanded head freely passes, and an integral retainer strap which forms a retaining space wherein said expanded head is loosely situated;

means for reducing wear between said expanded head and said stationary plate caused by the rotation of said shaft about its longitudinal axis;

a traveling plate having an aperture through which said shaft extends;

means for moving said traveling plate the length of said shaft in response to rotation of said shaft about its longitudinal axis, said traveling plate moving toward or away from said stationary plate depending on the direction of rotation of said shaft, said moving means including a threaded nut which is securely attached to said traveling plate and aligned with said aperture through which said shaft extends; and a rigid band extending between said stationary plate and said traveling plate, said rigid band including a plurality of sequential and incremental flat surfaces extending along one edge, and a file-like inner gripping surface strengthened by a V-shaped ridge forming the remainder of said band, said file-like inner gripping surface being split into two separate segments which are separated by and integrally connected to said V-shaped ridge, a first of said segments being situated between said plurality of flat surfaces and said V-shaped ridge, and extending between said stationary and traveling plates, and a second of said segments extending along the opposite edge of said band with respect to said plurality of flat surfaces.

20. An adjustable oil filter wrench as set forth in claim 19, wherein said plurality of sequential and incremental flat surfaces is situated in a different cross-sectional plane than said file-like inner gripping surface.

21. An adjustable oil filter wrench as set forth in claim 19, wherein said shaft combines with said band to completely encircle a portion of the circumference of an oil filter, said shaft being positioned tangentially to the nearest portion of the outer surface of the filter when said wrench is properly adjusted for the twisting of the filter.

* * * * *